US008115133B2

(12) United States Patent
Uchii et al.

(10) Patent No.: US 8,115,133 B2
(45) Date of Patent: Feb. 14, 2012

(54) GAS-INSULATED CIRCUIT BREAKER

(75) Inventors: Toshiyuki Uchii, Kanagawa (JP); Tadashi Mori, Kanagawa (JP); Takeshi Shinkai, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 188 days.

(21) Appl. No.: 12/717,444

(22) Filed: Mar. 4, 2010

(65) Prior Publication Data

US 2010/0224594 A1 Sep. 9, 2010

(30) Foreign Application Priority Data

Mar. 6, 2009 (JP) ..... 2009-054226

(51) Int. Cl.
*H01H 33/88* (2006.01)

(52) U.S. Cl. ..... 218/63; 218/116

(58) Field of Classification Search ..... 218/62–64, 218/116

See application file for complete search history.

(56) References Cited

U.S. PATENT DOCUMENTS

| | | | | | |
|---|---|---|---|---|---|
| 4,327,262 | A * | 4/1982 | Kull | 218/66 |
| 4,342,890 | A * | 8/1982 | Graf | 218/59 |
| 4,414,450 | A * | 11/1983 | Moll et al. | 218/23 |
| 4,843,199 | A * | 6/1989 | Niemeyer | 218/48 |
| 5,179,257 | A * | 1/1993 | Dufournet et al. | 218/62 |
| 5,723,840 | A * | 3/1998 | Bojic et al. | 218/60 |
| 5,750,949 | A * | 5/1998 | Rees et al. | 218/43 |
| 5,925,863 | A * | 7/1999 | Zehnder et al. | 218/53 |
| 5,977,502 | A | 11/1999 | Mizoguchi et al. | |
| 6,040,970 | A * | 3/2000 | Lehmann et al. | 361/115 |
| 6,163,001 | A * | 12/2000 | Zehnder et al. | 218/11 |
| 6,744,000 | B1 * | 6/2004 | Bergmann et al. | 218/64 |
| 2007/0221626 | A1 | 9/2007 | Uchii | |

FOREIGN PATENT DOCUMENTS

| | | |
|---|---|---|
| DE | 198 59 766 A1 | 6/2000 |
| JP | 2004-39312 | 2/2004 |
| JP | 2009-54481 | 3/2009 |

* cited by examiner

*Primary Examiner* — Truc Nguyen
(74) *Attorney, Agent, or Firm* — Oblon, Spivak, McClelland, Maier & Neustadt, L.L.P.

(57) ABSTRACT

A gas-insulated circuit breaker has a sealed container filled with gas; a pair of contacts so constructed as to be connected and separated each other in the sealed container; gas flow generation means for blasting the gas on an arc generated when the contacts are separated, the gas flow generation means including: an accumulation space, pressure increasing means for increasing the pressure of the pressure accumulation space, a gas passage connecting the pressure accumulation space to the arc, and an insulating nozzle that controls the flow of the gas from the pressure accumulation space to the arc; an inside-nozzle insulating member disposed co-axially with the insulating nozzle. The arc is generated in a space between an inner wall section of the insulating nozzle and an outer wall section of the inside-nozzle insulating member, and the gas flows in the space.

11 Claims, 4 Drawing Sheets

GAS-INSULATED CIRCUIT BREAKER

CROSS REFERENCE TO RELATED APPLICATION

This application is based upon and claims the benefits of priority from the prior Japanese Patent Application No. 2009-54226, filed in the Japanese Patent Office on Mar. 6, 2009, the entire content of which is incorporated herein by reference.

BACKGROUND OF THE INVENTION

The present invention relates to a puffer type gas-insulated circuit breaker that extinguishes an arc by blasting an insulating gas on the arc, and particularly to a gas-insulated circuit breaker having the improved structure of an insulating nozzle that blasts the insulating gas.

The gas-insulated circuit breaker is a device in which a pair of contacts is disposed inside a sealed container filled with insulating gas, and is often used as an on-off switch for electric current in an electric power transmission and distribution system. Hereinafter, an example of a conventional puffer type gas-insulated circuit breaker will be described in detail with reference to FIGS. 6 and 7.

FIG. 6 is a cross-sectional view of the puffer type gas-insulated circuit breaker. FIG. 7 is an enlarged cross-sectional view of an area near an arc 8. Both diagrams show a state during an opening operation. Each of components of the gas-insulated circuit breaker illustrated in the diagrams is basically in the shape of a coaxial cylinder. FIG. 7 illustrates only the upper half of the gas-insulated circuit breaker above a central axis.

As shown in FIG. 6, the puffer type gas-insulated circuit breaker is provided with a sealed container 1 that is made of grounded metal, insulator, or the like. An arc-extinguishing gas 2 of an insulating gas such as SF6 gas (sulfur hexafluoride gas) fills up the sealed container 1. SF6 gas has an excellent arc-extinguishing and electric insulating capability. The electric current on-off device filled with the gas is the mainstream of the high voltage electric transmission systems.

Inside the sealed container 1, as the pair of contacts, a fixed contact section 21 and a movable contact section 22 are so disposed as to face each other. The fixed contact section 21 and the movable contact section 22 can be connected and separated as desired. The fixed contact section 21 is fixed inside the sealed container 1, while the movable contact section 22 is connected to a driving mechanism through an operating rod (not shown) and can be moved in the left and right direction in FIG. 6 as desired. During operation, a high voltage is applied to the contact sections 21 and 22, and insulation is maintained by support insulating bodies 12 (only one of which is illustrated on the part of the fixed contact section 21 in FIG. 6). The contact sections 21 and 22 are mechanically supported by the support insulating bodies 12 inside the sealed container 1.

A fixed arcing contact 7*a* and a movable arcing contact 7*b* are provided on the fixed contact section 21 and the movable contact section 22, respectively. The arcing contacts 7*a* and 7*b* are in contact and conduction state during normal operation. During the opening operation, the arcing contacts 7*a* and 7*b* are separated from each other as the movable arcing contact 7*b* moves along with the movable contact section 22. When the arcing contacts 7*a* and 7*b* are separated from each other, the arc 8 occurs in a space between the arcing contacts 7*a* and 7*b*.

The following describes the configuration of the fixed contact section 21. On the opposite side (the left side in FIG. 6) of the fixed contact section 21 from the side facing the movable contact section 22, an exhaust pipe 9 made of metal is attached. A fixed-side hot gas flow 10*a* that flows from the space where the arc 8 occurs toward the fixed contact section 21 passes through the exhaust pipe 9. The upstream area of the fixed-side hot gas flow 10*a* that passes through the exhaust pipe 9 is around the arc 8, and the downstream area is around the internal space of the sealed container 1.

The following describes the configuration of the movable contact section 22. In the movable contact section 22, a hollow rod 11 is provided. The hollow rod 11 is connected to the movable arcing contact 7*b*. The hollow rod 11 is extends toward the opposite side (the right side in FIG. 6) of the movable contact section 22 from the side facing the fixed contact section 21. A movable-side hot gas flow 10*b* that flows from the space where the arc 8 occurs toward the movable contact section 22 passes through the hollow rod 11. That is, like the fixed-side hot gas flow 10*a*, the upstream area of the movable-side hot gas flow 10*b* that passes through the hollow rod 11 is around the space where the arc 8 occurs, and the downstream area is around the internal space of the sealed container 1.

Moreover, on the movable contact section 22, a gas flow generation means is provided as a distinctive component of the puffer type gas-insulated circuit breaker. The gas flow generation means is a means to generate a gas flow 10*c* from a puffer chamber 5. The gas flow 10*c* is blasted on the arc 8. After being blasted on the arc 8, the gas flow 10*c* is divided into the gas flows 10*a* and 10*b* described above.

The major components of the gas flow generation means are a piston 3 fixed on the sealed container 1 and a cylinder 4 that houses the piston 3. The piston 3 can slide in the cylinder 4 as desired. The internal space of the cylinder 4 serves as the puffer chamber 5. An insulating nozzle 6 is disposed on the front end section (the left side in FIG. 6) of the cylinder 4. The insulating nozzle 6 communicates with the puffer chamber 5. The cylinder 4 is attached to the movable contact section 22. The insulating nozzle 6 is made of a heat resistance insulating material such as polytetrafluoroethylene, and emits an arc-extinguishing gas 2 stored in the puffer chamber 5 as the above-described gas flow 10*c*, with the narrowest portion of a gas passage 6*a* serving as a throat section 6*b*.

The following describes the correlation in diameter between the insulating nozzle 6 and the arcing contacts 7*a* and 7*b*. As described above, FIGS. 6 and 7 illustrate a state during the opening operation. The arcing contacts 7*a* and 7*b* are therefore separate from each other. However, when the gas-insulated circuit breaker is turned on, i.e. the contacts are in "closed" state as a switch, both arcing contacts 7*a* and 7*b* need to be in contact and conduction state.

Accordingly, as shown in FIG. 7, the correlation between the outer diameter $\phi F1$ of the fixed arcing contact 7*a* and the inner diameter $\phi M1$ of the movable arcing contact 7*b* is as follows:

$\phi F1 > \phi M1$. The movable arcing contact 7*b* that moves is always in contact with the fixed arcing contact 7*a*.

Moreover, the insulating nozzle 6 blasts the gas flow 10*c* toward the arc 8 generated between the arcing contacts 7*a* and 7*b*. The insulating nozzle 6 is so formed to encircle the arcing contacts 7*a* and 7*b*. Therefore, it is clear that the inner diameter $\phi N1$ of the throat section 6*b* need to be set larger than the outer diameter $\phi F1$ of the fixed arcing contact 7*a*. That is, the correlation in diameters between the insulating nozzle 6 and the arcing contacts 7*a* and 7*b* is as follows: The diameter of the insulating nozzle 6, the fixed arcing contact 7*a*, and the movable arcing contact 7*b* becomes smaller in that order, i.e. $\phi N1 > \phi F1 > \phi M1$.

The following describes an arc interruption process of the gas-insulated circuit breaker having the above configuration with reference to FIG. 7. During the opening process of the gas-insulated circuit breaker, the driving mechanism (not shown) operates to move the movable contact section 22 in the right direction in FIG. 7, thereby separating the movable contact section 22 from the fixed contact section 21. In response, the cylinder 4 fixed on the movable contact section 22 also moves in the right direction in FIG. 7.

At this time, the piston 3 in the cylinder 4 moves relatively in the left direction in FIG. 7 to compress the puffer chamber 5, thereby increasing the pressure of the arc-extinguishing gas 2 inside the puffer chamber 5. As a result, the arc-extinguishing gas 2 inside the puffer chamber 5 flows toward the insulating nozzle 6 as a high-pressure gas flow 10*c*. Therefore, the insulating nozzle 6 blasts the strong gas flow 10*c* on the arc 8 generated between the arcing contacts 7*a* and 7*b*. Thanks to the gas flow 10*c*, the conductive arc 8 disappears, ensuring the interruption of electric current.

The gas flow 10*c* that is blasted on the high-temperature arc 8 is heated to a high temperature, and is divided into the fixed-side hot gas flow 10*a* and the movable-side hot gas flow 10*b*. The fixed-side hot gas flow 10*a* and the movable-side hot gas flow 10*b* then flow away from the area where the arc 8 occurs between the arcing contacts 7*a* and 7*b*, pass through the exhaust pipe 9 and the hollow rod 11, respectively, and are finally released in the sealed container 1.

The following describes a physical mechanism of interrupting the arc 8 by blasting the gas flow 10*c* during the above-described arc interruption process. Here, FIG. 8 is used along with the above-described FIG. 7. A diagram on the upper side of FIG. 8 is a cross-sectional view of the throat section 6*b* of the insulating nozzle 6 along the radial direction, and a diagram on the lower side of FIG. 8 illustrates the temperature distribution inside the throat section 6*b*.

The gas flow 10*c* that enters the insulating nozzle 6 from the high-pressure puffer chamber 5 flows at the fastest speed through the throat section 6*b* that is the narrowest point of the gas passage 6*a* of the insulating nozzle 6. Since electric current flows through the arc 8, the temperature of the gas flow 10*c* is high due to Joule heating.

That is, when the gas flow 10*c* is being blasted on the arc 8, the gas flow 10*c* that is flowing around the high-temperature arc 8 at high speed is lower in temperature than the arc 8. Therefore, when the arc 8 is being interrupted, the temperature distribution inside the throat section 6*a* of the insulating nozzle 6 is high around the central portion, i.e., the arc 8, as shown in the diagram on the lower side of FIG. 8. The temperature distribution becomes lower toward the wall surface of the throat section 6*b*, i.e., the peripheral portion. The temperature gradient is extremely steep.

Therefore, in the lower-temperature gas flow 10*c* that flows outside the arc 8 at high speed, a heat flow 41 (illustrated in FIG. 8) occurs from the central portion toward the peripheral portion, depriving the arc 8 of heat. Therefore, the arc 8 is cooled down. The electric conductivity of the arc 8 monotonically decreases as the temperature decreases. Therefore, the electric conductivity of the arc 8 significantly decreases as the arc 8 is cooled down. As a result, the arc 8 is cooled down until the arc 8 becomes an insulator, ensuring the interruption of electric current.

Moreover, the fact that the temperature of the arc 8 reaches several tens of thousands K around an over-current peak also contributes to the interruption of electric current. That is, during the process of interrupting the arc 8, the insulating nozzle 6 is being exposed to the extremely high temperature of the arc 8. Therefore, the component of the insulating nozzle 6, which is an insulating material like polytetrafluoroethylene, melts and is gasified. It is known that as a result, an ablation gas 31 emerges from the inner wall of the throat section 6*b* as shown in FIG. 7.

Accordingly, the gas flow 10*c* that is blasted from the insulating nozzle 6 to the arc 8 is not made of only the arc-extinguishing gas 2 but is a mixed gas of the arc-extinguishing gas 2 and the ablation gas 31. When the component of the solid insulating nozzle 6 is gasified, the volume increases significantly, resulting in a large value that represents the volume of the ablation gas 31.

That is, the pressure of the puffer chamber 5 further increases as the ablation gas 31 is generated from the insulating nozzle 6, promoting an increase in the pressure of the gas flow 10*c* and having a preferable effect to interrupt the arc. The above has described the typical configuration of the puffer type gas-insulated circuit breaker and the principle of arc interruption.

A puffer type gas-insulated circuit breaker, like the one described above, can achieve a high arc-extinguishing capability by blasting the arc-extinguishing gas 2 stored in the puffer chamber 5 on the arc 8 generated at the time of electric current interruption. Therefore, such a puffer type gas-insulated circuit breaker is widely used as a protective on-off switch in a high voltage electric transmission system for 72 kV or more and has been improved in various ways.

For example, the conventional arts disclosed in Japanese Patent Publication No. 7-97466 (Patent Document 1), Japanese Patent Publication No. 7-109744 (Patent Document 2) and Japanese Patent Application Publication No. 2001-283693 (Patent Document 3), the entire contents of which are incorporated herein by reference, are well known. Here, although the mechanisms disclosed in Patent Documents 1 to 3 are not described in detail with reference to drawings, the outlines of the mechanisms will be described with reference to the above-described FIG. 7. According to Patent Document 1, holes are formed around the hollow rod 11 near the movable contact section 22. The movable-side hot gas flow 10*b* is heated to high temperatures as the arc 8 occurs. Therefore, at the initial stage of the operation in which the arc 8 is interrupted, the puffer chamber 5 actively takes in the high-temperature movable-side hot gas flow 10*b* via the holes (not shown in FIG. 7) of the hollow rod 11, thereby contributing to the increase in the pressure of the puffer chamber 5.

Moreover, in the gas-insulated circuit breaker disclosed in Patent Document 2, the puffer chamber 5 is divided into two along the axial direction, thereby limiting the capacity of the puffer chamber 5 near the arc 8, thereby increasing the blasting pressure for the arc 8 especially at the time of interrupting large electric current. Moreover, a check valve (not shown in FIG. 7) is provided at the division section of the puffer chamber 5, avoiding applying a high pressure directly on the piston 3. Therefore, an increase in driving force of the movable contact section 22 is prevented.

Furthermore, the gas-insulated circuit breaker disclosed in Patent Document 3 is characterized by a magnetic field generation means (not shown in FIG. 7) that is provided in addition to a gas flow generation means for generating a flow component in the radial direction of the arc 8: The magnetic field generation means generates magnetic pressure in the radial direction of the arc 8. Such a gas-insulated circuit breaker can extinguish the arc while squeezing the arc 8 in the radial direction in a portion of the area where the arc 8 occurs.

That is, according to the technique of Patent Document 3, a combined effect of two separate effects, which do not interfere with each other, can be obtained: the fluid effect of gas flows and the electromagnetic effect of magnetic fields.

Therefore, it is possible to decrease the arc time constant by efficiently squeezing the arc diameter, thereby swiftly extinguishing the arc 8.

According to the conventional arts like those disclosed in Patent Documents 1 to 3, it is possible to actively take advantage of the heat energy of the arc 8 or the electromagnetic energy of magnetic fields as the energy to increase the pressure of the puffer chamber 5 as well as the mechanical compressive effect of the piston 3, increasing the blasting pressure of the arc-extinguishing gas 2 and leading to an improvement in opening performance.

Moreover, the conventional arts like those disclosed in Patent Documents 1 to 3 are less dependent on the mechanical compression by the piston 3 because of the use of the other energy sources, compared with an ordinary gas-insulated circuit breaker that can achieve an increase in the pressure of the same puffer chamber 5. Therefore, even the small piston 3 can increase the pressure enough to interrupt electric current.

Therefore, the gas-insulated circuit breaker can be downsized, and the amount of gas that fills the sealed container 1 can be reduced. Moreover, thanks to the introduction of the small piston 3, less energy is required to drive the movable contact section 22. Thus, the driving mechanism is downsized, costs are reduced, and mechanical reliability and economic efficiency are increased.

In the gas-insulated circuit breaker of a type that actively uses the heat energy of the arc 8, if the amount of the arc-extinguishing gas 2 in the puffer chamber 5 is not enough, the pressure inside the puffer chamber 5 does not increase easily or falls immediately after an increase in the pressure inside the puffer chamber 5.

In such cases, even if the puffer chamber 5 takes in the heat energy of the arc 8, the thermal compression effect of the arc 8 cannot be tapped effectively. Moreover, if the thermal compression effect of the arc 8 is used less frequently, then it becomes difficult to reduce the mechanical compression effect relatively. As a result, it becomes difficult to achieve such effects, like a reduction in driving force or preventing an increase in the amount of contained gas, which lead to the downsizing of the device.

Accordingly, in the gas-insulated circuit breaker of a type that takes the heat energy of the arc 8 in the puffer chamber 5, it is important to make the passage cross-section area S1 (shown in FIG. 7) of the gas passage 6*a* of the throat section 6*b* of the insulating nozzle 6 small in size and to limit the amount of the gas flow blasted from the insulating nozzle 6, in order to reduce the amount of the gas flow exhausted from the puffer chamber 5.

However, if the passage cross-section area S1 of the gas passage 6*a* is simply made small, new problems arise. That is, making the passage cross-section area S1 of the gas passage 6*a* small means making the inner diameter ϕN1 of the throat section 6*b* of the insulating nozzle 6 small. As described above, as for the diameters of the insulating nozzle 6 and the arcing contacts 7*a* and 7*b*, the correlation ϕN1>ϕF1>ϕM1 remains unchanged given the certainty of the contact and conduction state between the contacts 7*a* and 7*b*.

Therefore, when the inner diameter ϕN1 of the throat section 6*b* of the insulating nozzle 6 is narrowed, the outer diameter ϕF1 of the fixed arcing contact 7*a* and the inner diameter ϕM1 of the movable arcing contact 7*b* need to be narrowed more. That is, the tiny components constitute the arcing contacts 7*a* and 7*b*. As a result, the arcing contacts 7*a* and 7*b* can be easily damaged at the time of electric current interruption, and the durability of the arcing contacts 7*a* and 7*b*, as members, decreases (More specifically, the number of times electric current is interrupted before the replacement of the arcing contacts 7*a* and 7*b* drops).

Moreover, when the contacts of the gas-insulated circuit breaker are separated, a high voltage is applied to between the arcing contacts 7*a* and 7*b*. At this time, the electric current insulating state needs to be maintained. If the diameters of the arcing contacts 7*a* and 7*b* are small, the electric field intensifies at the tips of the arcing contacts 7*a* and 7*b*. Therefore, in order to ensure the opening operation for the high electric field, it is necessary to increase the separation distance between the arcing contacts 7*a* and 7*b* and the speed in separating the arcing contacts 7*a* and 7*b*.

That is, even if the heat energy of the arc 8 is used to increase the pressure of the puffer chamber 5 to reduce the driving energy, the effectiveness of driving energy reduction decreases accordingly as the separation distance and the separating speed increase due to the reduction in diameter of the arcing contacts 7*a* and 7*b*, making it difficult to downsize the device.

As a conventional art to solve the above problems, a gas-insulated circuit breaker is for example proposed in Japanese Patent Application Publication No. 2004-39312 (Patent Document 4), the entire content of which is incorporated herein by reference. According to the technique, in order to change the size of the gas passage cross-section area inside the insulating nozzle 6, a gas passage adjustment mechanism (not shown) is provided that has an iris diaphragm structure used in a camera or the like. Thanks to the operation of the gas passage adjustment mechanism, the passage cross-section area S1 of the gas passage 6*a* of the insulating nozzle 6 decreases in size in accordance with the operation of separating the contacts of the contact section.

That is, in the gas-insulated circuit breaker disclosed in Patent Document 4, the passage cross-section area S1 of the gas passage 6*a* is reduced in size by the gas passage adjustment mechanism, thereby reducing the amount of the gas flow 10*c* flowing from the insulating nozzle 6 at the time of separating the contacts of the contact section. Therefore, a sufficient amount of the arc-extinguishing gas 2 remains in the puffer chamber 5 when the puffer chamber 5 takes in the heat energy of the arc 8, thereby making it possible to increase the contribution of the heat energy of the arc 8 to the increase in the pressure of the puffer chamber 5.

Moreover, the passage cross-section area S1 of the gas passage 6*a* of the insulating nozzle 6 is controlled by squeezing the gas passage adjustment mechanism. Therefore, the inner diameter ϕN1 of the throat section 6*b* of the insulating nozzle 6 need not be narrowed. Moreover, the arcing contacts 7*a* and 7*b* also need not be narrowed in diameters. Therefore, it is possible to avoid such problems like a decrease in durability of the arcing contacts 7*a* and 7*b* and a rise in electric field at the tips of the arcing contacts 7*a* and 7*b*, which are associated with the smaller diameter. Accordingly, it is possible to suppress the electric field at the tips of the arcing contacts 7*a* and 7*b*, and it is not necessary to increase the separation distance of the contacts 7*a* and 7*b* and the separating speed. As a result, driving energy can be reduced, and the device can be downsized.

As described above, in the gas-insulated circuit breaker disclosed in Patent Document 4, the gas passage adjustment mechanism is provided to suppress the amount of the gas flow exhausted from the puffer chamber 5 via the insulating nozzle 6, leading to an increase in the pressure of the puffer chamber 5 with the help of the heat energy of the arc 8 and resulting in a further improve in opening performance.

However, the following problems with the conventional puffer type gas-insulated circuit breakers have been pointed out. That is, since the puffer type gas-insulated circuit breaker is designed to blast the arc-extinguishing gas 2 on the arc 8, the opening performance is largely determined by the cooling capability of the arc-extinguishing gas 2. As a conventional arc-extinguishing gas 2, SF6 gas having a high cooling capability is widely used. However, these days, the use of SF6 gas entails the following problems.

SF6 gas is recognized as a man-made gas that is a major contributor to global warming. In terms of environmental protection, it is desirable that the amount of SF6 gas to be used should be reduced. Accordingly, a natural gas that has less impact on the environment, such as N2 gas or CO2 gas, is under consideration as a substitute gas for SF6 gas.

However, when the substitute gas is used, the substitute gas has a lower cooling capability compared with SF6 gas because the substitute gas and SF6 gas are different in physicochemical properties. Therefore, the problem is that the cooling effect of the arc 8 decreases. Accordingly, when N2 or CO2 gas is used, a structure is urgently required that can increase the cooling effect of the arc 8 without depending on the cooling capability of the arc-extinguishing gas 2.

The gas-insulated circuit breaker disclosed in Patent Document 4 is of a type that actively makes use of the heat energy of the arc to increase the pressure of the puffer chamber and is provided with the gas passage adjustment mechanism. Therefore, the amount of the gas flow flowing from the insulating nozzle can be efficiently suppressed. Moreover, it is possible to increase the contribution of the arc heat to the increase in the pressure of the puffer chamber. However, the gas passage adjustment mechanism employs the iris diaphragm structure used in a camera or the like. Accordingly, the number of components of the gas passage adjustment mechanism increases. Moreover, since the components of the gas passage adjustment mechanism work in conjunction with each other, it takes time to adjust or assemble the gas passage adjustment mechanism to ensure the smooth operation of the components. The problem is, therefore, that as for the members that work to suppress the amount of the gas flow from the insulating nozzle, production costs are high.

BRIEF SUMMARY OF THE INVENTION

The present invention has been made to solve the above problems. The object of the present invention is to provide a gas-insulated circuit breaker that can contribute to extending product life and reducing impact on the environment, lead to downsizing and lower costs, and achieve high opening performance and high reliability.

In order to achieve the object, the present invention provides a gas-insulated circuit breaker comprising: a sealed container filled with a gas; a pair of contacts so constructed as to be connected and separated each other as desired in the sealed container; gas flow generation means for blasting the gas on an arc generated when the contacts are separated, the gas flow generation means including: at least one pressure accumulation space, at least one pressure increasing means for increasing the pressure of the pressure accumulation space, at least one gas passage that connects the pressure accumulation space to the arc, and an insulating nozzle that controls the flow of the gas from the pressure accumulation space to lead the gas to the arc; an inside-nozzle insulating member disposed co-axially with respect to the insulating nozzle inside the insulating nozzle, wherein the arc is generated in a space between an inner wall section of the insulating nozzle and an outer wall section of the inside-nozzle insulating member, and the gas flows in the space.

According to the present invention having the above configuration, since the inside-nozzle insulating member is disposed in the insulating nozzle, the high-temperature arc generated at the time of the opening operation is in contact not only with the inner wall section of the insulating nozzle but with the outer wall section of the inside-nozzle insulating member. Therefore, the arc is cooled down structurally. Thus, it is possible to secure excellent opening performance even as the lower-cooling-performance gas is used, and the gas that has less impact on the environment can be used. Therefore, while the opening performance is maintained at a satisfactory level, harmony with the environment can be achieved.

Moreover, since the inside-nozzle insulating member is incorporated in the insulating nozzle, the cross-section area of the gas passage is made smaller in size. Therefore, it is possible to reduce the amount of the gas flow exhausted from the pressure accumulation space, thereby making more use of the arc heat in increasing the pressure of the pressure accumulation space. In addition, since the inner diameter of the insulating nozzle need not be narrowed, it is unnecessary to reduce the members in diameter inside the insulating nozzle.

As a result, it is possible to secure the durability of the members inside the insulating nozzle and extend product life. Moreover, since nothing is reduced to extremely small size in diameter, the generation of a high electric field is avoided. The separation distance and the separating speed are suppressed, and it is possible to downsize and reduce driving energy. Furthermore, the inside-nozzle insulating member that brings about such effects has a simple structure and is co-axial with respect to the insulating nozzle. The number of members of the inside-nozzle insulating member is far smaller than a gas passage adjustment mechanism having an iris diaphragm structure. In addition, the inside-nozzle insulating member has no movable parts. Therefore, production costs are extremely low, and an excellent level of economic efficiency is achieved.

According to the present invention, the gas-insulated circuit breaker has an extremely simple structure in which the co-axial inside-nozzle insulating member is disposed in the insulating nozzle, contributing to extending product life and reducing impact on the environment, leading to downsizing and lower costs, and achieving improved opening performance and high reliability.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

Figure 2:
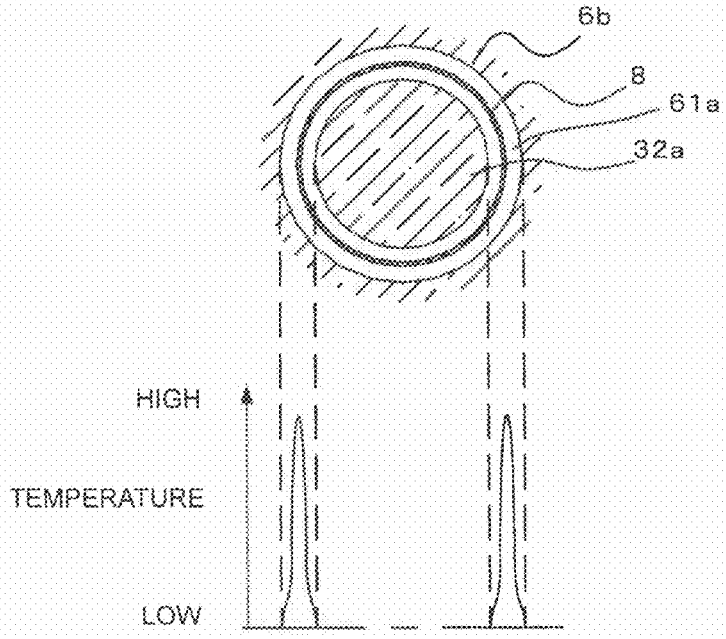
Figure 3:
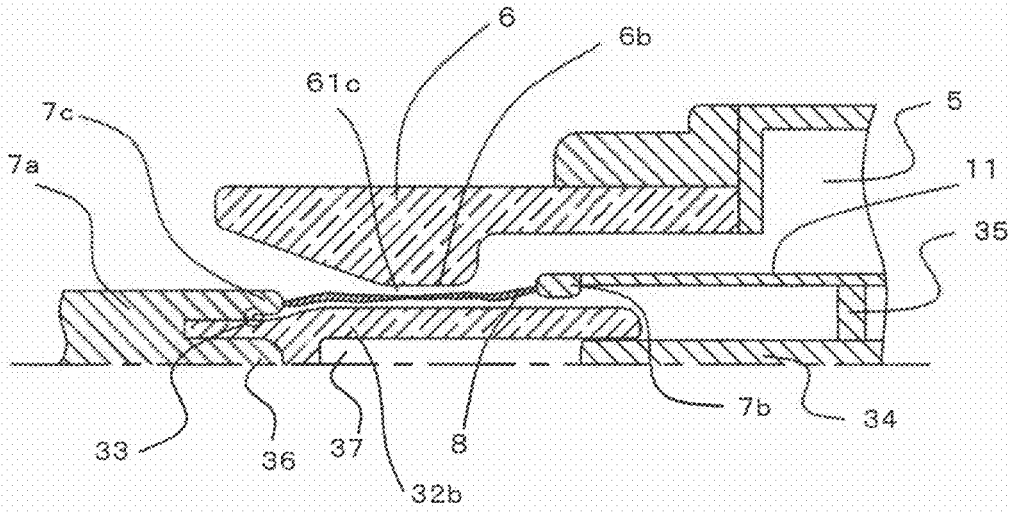
Figure 4:
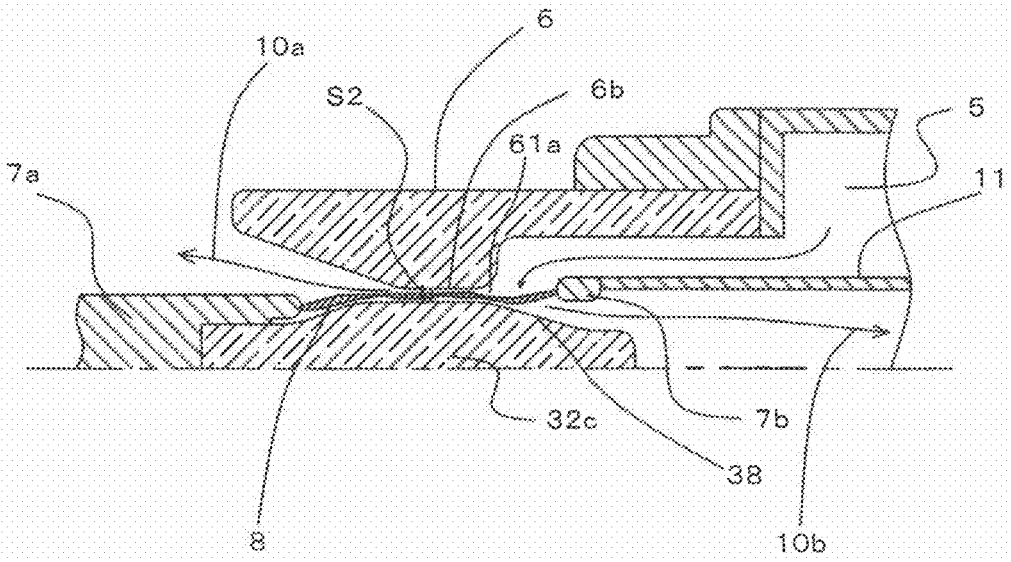
Figure 5:
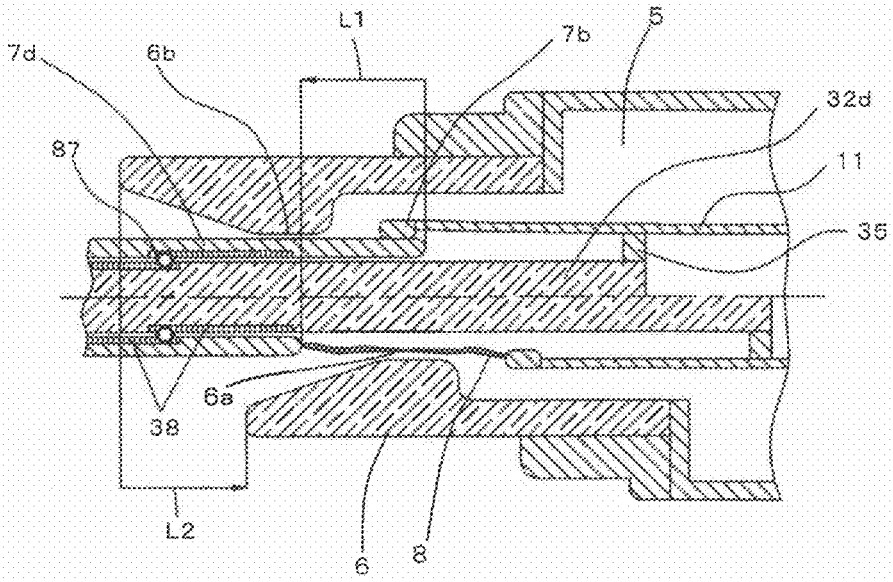
Figure 6:
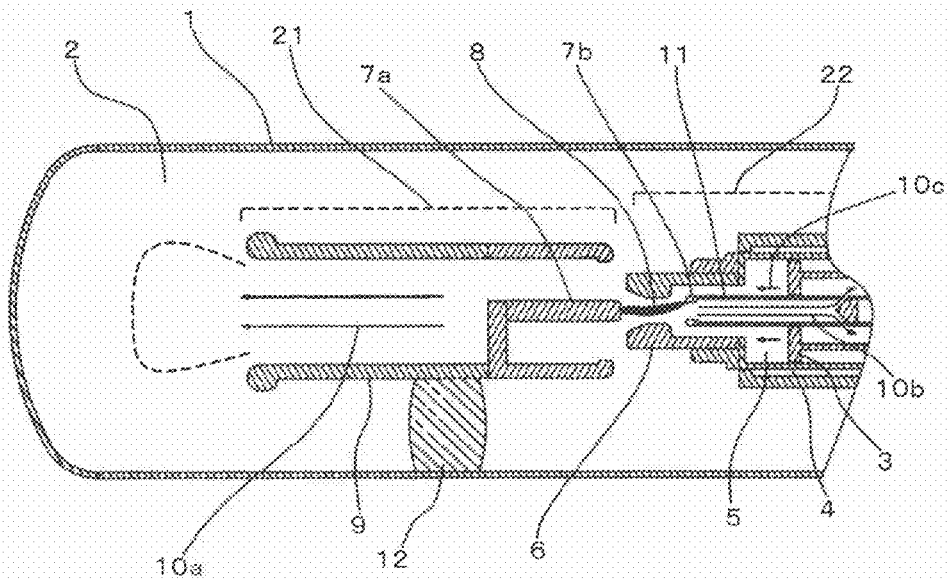
FIG.6 (PRIOR ART)
Figure 7:
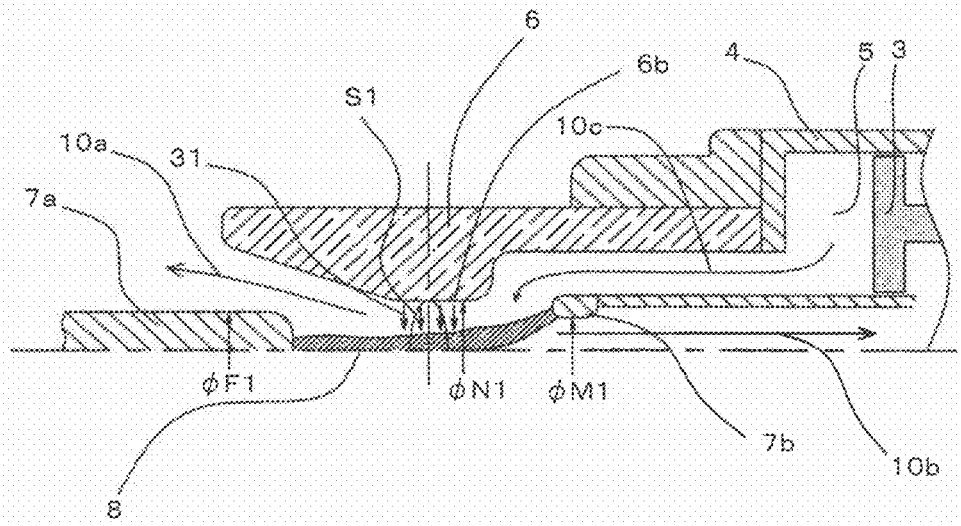
FIG.7 (PRIOR ART)
Figure 8:
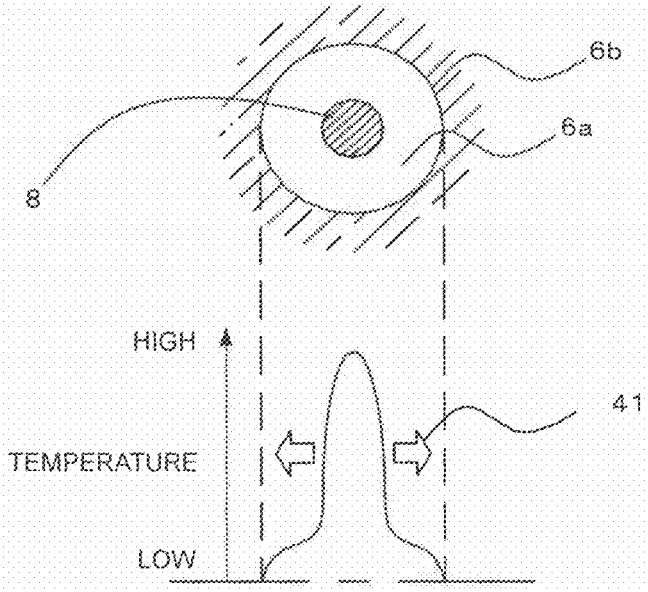
FIG.8 (PRIOR ART)

Upper part of FIG. 2 is a radial cross-sectional view of a throat section of an insulating nozzle of the gas-insulated circuit breaker of the first embodiment of the present invention, and lower part of FIG. 2 is a diagram illustrating the temperature distribution inside the throat section;

FIG. 3 is a structural diagram of a gas-insulated circuit breaker according to a second embodiment of the present invention;

FIG. 4 is a structural diagram of a gas-insulated circuit breaker according to a third embodiment of the present invention;

FIG. 5 is a structural diagram of a gas-insulated circuit breaker according to a fourth embodiment of the present invention, wherein the upper portion of FIG. 5 above the central axis illustrates a state (closed state) in which the gas-insulated circuit breaker is turned on, and the lower portion of FIG. 5 illustrates a state during the process of opening;

FIG. 6 is an overall structural diagram of a conventional puffer type gas-insulated circuit breaker;

FIG. 7 is an enlarged view of a part of the conventional puffer type gas-insulated circuit breaker near an arc; and Upper part of FIG. 8 is a radial cross-sectional view of a throat section of an insulating nozzle of a conventional puffer type gas-insulated circuit breaker, and lower part of FIG. 8 is a diagram illustrating the temperature distribution inside the throat section.

DETAILED DESCRIPTION OF THE INVENTION

The following describes in detail an example of a gas-insulated circuit breaker according to embodiments of the present invention with reference to drawings. Incidentally, the same components as those described as conventional arts in FIGS. 6 to 8 are denoted by the same reference symbols and will not be described.

(1) First Embodiment

Configuration

Figure 1:
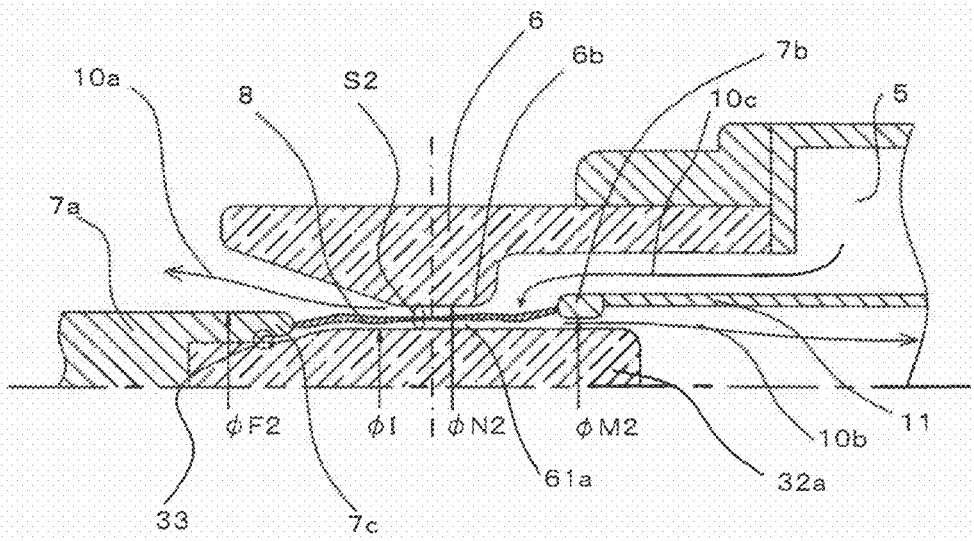
FIG. 1 is a structural diagram of a gas-insulated circuit breaker according to a first embodiment of the present invention.

A first embodiment of the present invention will be described with reference to FIGS. 1 and 2. FIG. 1 illustrates a situation near an arc during the opening operation of a gas-insulated circuit breaker. Since the components of the gas-insulated circuit breaker are symmetrical about a symmetry axis, FIG. 1 illustrates only the upper half of the gas-insulated circuit breaker above the central axis.

The portion of the gas-insulated circuit breaker not illustrated in FIG. 1 have the same configuration as the conventional gas-insulated circuit breaker of a type that actively makes use of the heat energy of the arc 8 to increase the pressure of the puffer chamber 5. A diagram on the upper side of FIG. 2 is a cross-sectional view of the throat section 6*b* of the insulating nozzle 6 along the radial direction, and a diagram on the lower side illustrates the temperature distribution inside the throat section 6*b*.

The most different feature in configuration between the conventional gas-insulated circuit breaker and that of the first embodiment is that a cylindrical inside-nozzle insulating member 32*a* is so provided in the insulating nozzle 6 as to maintain a co-axial relation with the insulating nozzle 6. Moreover, according to the present embodiment, since the gas passage 61*a* of the insulating nozzle 6 is sandwiched between the outer diameter ϕI of the inside-nozzle insulating member 32*a* and the inner diameter ϕN2 of the throat section 6*b* of the insulating nozzle 6, the gas passage 61*a* is in the shape of a pipe (an annulus). The arc 8 that occurs in the gas passage 61*a* is substantially in the shape of a ring (hollow cylinder).

Like the insulating nozzle 6, the inside-nozzle insulating member 32*a* is made of insulating materials that can resist the high-temperature arc 8, such as polytetrafluoroethylene and the like. The front end section of the fixed arcing contact 7*a* faces the movable arcing contact 7*b*. The inside-nozzle insulating member 32*a* is firmly bonded to the end face of the front end section. Around the bonded surface between the inside-nozzle insulating member 32*a* and the fixed arcing contact 7*a*, a front end section 7*c* is so formed as to extend toward the movable arcing contact 7*b*.

That is, on the bonded surface between the inside-nozzle insulating member 32*a* and the fixed arcing contact 7*a*, there is a triple overlapping point section 33 where the following three media are in contact with each other: the fixed arcing contact 7*a* which is made of metal, the inside-nozzle insulating member 32*a* which is an insulating body, and the arc-extinguishing gas 2. The triple overlapping point section 33 is positioned deeper than the front end section 7*c* of the fixed arcing contact 7*a* (on the left side of the front end section 7*c* in FIG. 1).

Moreover, the outer diameter ϕI of the inside-nozzle insulating member 32*a* is set smaller in size than the inner diameter ϕM2 of the movable arcing contact 7*b*. According to the present embodiment, if the inner diameter of the throat section 6*b* of the insulating nozzle 6 and the outer diameter of the fixed arcing contact 7*a* are assumed to be ϕN2 and ϕF2, respectively, the relation ϕN2>ϕF2>ϕM2 remains unchanged given the certainty of the contact and conduction state between the arcing contacts 7*a* and 7*b*. Therefore, the relation ϕN2>ϕF2>ϕM2>ϕI is achieved. If described by name of members, the relation of the sizes is as follows: [the insulating nozzle 6]>[the fixed arcing contact 7*a*]>[the movable arcing contact 7*b*]>[the inside-nozzle insulating member 32*a*].

Here, assume that the inner diameter ϕN2 of the throat section 6*b* of the insulating nozzle 6 is substantially equal to the inner diameter ϕN1 of the throat section 6*b* of the conventional insulating nozzle 6. Since the inside-nozzle insulating member 32*a* is incorporated in the insulating nozzle 6, the passage cross-section area S2 of the gas passage 61*a* is accordingly set smaller than the passage cross-section area S1 of the conventional gas passage 6*a*.

Incidentally, not all the insulating nozzle 6, arcing contacts 7*a* and 7*b*, and inside-nozzle insulating member 32*a* may be symmetrical about a symmetry axis. That is, not all the insulating nozzle 6, arcing contacts 7*a* and 7*b*, and inside-nozzle insulating member 32*a* may be circular in cross section. Even if the members are not symmetrical about a symmetry axis, the above-described relation ϕN2>ϕF2>ϕM2>ϕI remains unchanged by and large in terms of the dimensions, thereby ensuring the closing (turn-on) operation of the gas-insulated circuit breaker.

Operation and Advantages

The advantage of the first embodiment having the above configuration is that the cooling performance of the arc 8 is increased. The cooling performance of the arc 8 is increased by the improvement of the configuration without depending on the cooling capability of the arc-extinguishing gas 2. That is, the arc 8 that flashes between the arcing contacts 7*a* and 7*b* ignites in the pipe-shaped gas passage 61*a* formed between the insulating nozzle 6 and the inside-nozzle insulating member 32*a*. At this time, the insulating nozzle 6 and the inside-nozzle insulating member 32*a* are firmly fixed and held so that the co-axial relation therebetween is maintained.

Accordingly, the arc 8 does not bias to one side and ignites co-axially in the gas passage 61*a* as illustrated in the upper part of FIG. 2. That is, the arc 8 that ignites inside the gas passage 61*a* is in the shape of a ring, and the gas flow 10*c* hits the arc 8 from the outer- and internal-circumference sides. A diagram on the lower side of FIG. 2 shows the temperature distribution in the throat section 6*b* of the insulating nozzle 6 in the above case.

That is, the arc 8 is more cooled down as an area where the high-temperature part of the arc 8 and the low-temperature gas flow 10*c* flowing around the arc 8 are in contact with each other increases in size. According to the conventional structure illustrated in FIG. 8, the inner wall of the insulating nozzle 6 and the periphery of the arc 8 are in contact with each other. In the case of the first embodiment, the inner wall of the insulating nozzle 6 and the periphery of the arc 8 are similarly in contact with each other, and the surface of the outer wall of the inside-nozzle insulating member 32*a* and the inner surface side of the arc 8 are also in contact with each other. That is, the area where the high-temperature part of the arc 8 and the low-temperature gas around the arc 8 are in contact with each other is almost twice as large as in the conventional case. Therefore, the opening performance is improved dramatically.

According to the first embodiment, the cooling performance of the arc 8 can be improved structurally as described above, thereby achieving excellent opening performance. Moreover, the fact that the opening performance has improved thanks to the improvement in cooling performance of the arc 8 means that if the same degree of opening performance as in the conventional case is sought, it is possible to decrease the blasting pressure for the arc 8, i.e. the pressure of the puffer chamber 5. The reduction in the pressure of the puffer chamber 5 leads to a decrease in the driving reaction force applied to the piston 3. Therefore, the driving energy can be reduced.

Moreover, the major advantage of the first embodiment is that the passage cross-section area S2 is reduced thanks to the inside-nozzle insulating member 32*a* with an extremely simple configuration. That is, as the members that make it possible to reduce the passage cross-section area S2, the cylindrical inside-nozzle insulating member 32*a* that are incorporated co-axially into the insulating nozzle 6 is employed instead of the complex members like the conventional iris diaphragm structure disclosed in Patent Document 4. Therefore, production costs can be reduced, and economic efficiency improves.

Moreover, the amount of the gas flow 10*c* exhausted from the puffer chamber 5 is suppressed by the reduction in size of the passage cross-section area S2, thereby increasing the contribution of the heat energy of the arc 8 to the increase in the pressure of the puffer chamber 5. Therefore, according to the first embodiment, the sufficient contribution of the heat energy of the arc 8 can be secured.

Furthermore, the gas-insulated circuit breaker of the first embodiment is designed to realize the relation $\phi N2>\phi F2>\phi M2$, or if described by name of members, [the insulating nozzle 6]>[the fixed arcing contact 7*a*]>[the movable arcing contact 7*b*]. Accordingly, when the movable contact section 22 is switched from separated-contact state to closed-contact state in the turn-on or closing operation, the components do not interfere with each other, and the turn-on operation proceeds with no problem.

Furthermore, according to the first embodiment, when the passage cross-section area S2 is made small, the diameters $\phi F2$ and $\phi M2$ of the arcing contacts 7*a* and 7*b* are not made small. Therefore, more heat energy of the arc 8 is used to increase the pressure of the puffer chamber 5, and the reduction in the durability of the arcing contacts 7*a* and 7*b* can be avoided even as the diameters decreases.

Accordingly, the durability of the arcing contacts 7*a* and 7*b* improves. In addition, the increase in electric field at the tips of the arcing contacts 7*a* and 7*b* can be suppressed. Therefore, it is not necessary to increase the separation distance between the arcing contacts 7*a* and 7*b* and the separating speed as in the conventional case.

As a result, in the gas-insulated circuit breaker that can actively make use of the heat energy of the arc 8 to increase the pressure of the puffer chamber 5, the extension of the distance that the movable contact section 22 moves can be avoided, and the separating speed can be maintained as the same level as in the conventional case. It is also possible to downsize the device and reduce driving energy. In that manner, according to the first embodiment, it is possible to simultaneously solve the conflicting problems, i.e. the reduction in driving energy due to the use of the heat of the arc 8 and the deterioration in durability of the arcing contacts 7*a* and 7*b*. The downsizing of the device and the extending of product life are possible simultaneously.

Incidentally, according to the first embodiment, the passage cross-section area S2 of the gas passage 61*a* is set slightly larger than the passage cross-section area S1 of the conventional gas-insulated circuit breaker. That is because, in the insulating nozzle 6 of the first embodiment, the gas flow 10*c* flowing through the gas passage 61*a* is affected not only by friction with the inner-wall side of the throat section 6*b* of the insulating nozzle 6 as in the conventional case but also by friction with the outer-wall side of the inside-nozzle insulating member 32*a*.

Accordingly, given how much the friction affects, it is desirable that the cross-section area S2 be set larger, so that the effective amount of the gas flow 10*c* is at the same level as in the case of the cross-section area S1 of the conventional gas passage 6*a* in terms of fluid mechanics. Therefore, the diameters $\phi F2$ and $\phi M2$ of the arcing contacts 7*a* and 7*b* need not be narrowed, and the most appropriate combination can be realized in terms of durability and diameter of members. Thus, economic efficiency and reliability are further improved.

Moreover, according to the first embodiment, the high-temperature arc 8 is in contact not only with the insulating nozzle 6 but with the inside-nozzle insulating member 32*a*. Therefore, more insulating bodies are exposed to the heat of the arc 8 compared with the conventional gas-insulated circuit breaker, and the amount of the ablation gas 31 to be generated increases. Accordingly, the pressure of the puffer chamber 5 further increases thanks not only to the heat energy of the arc 8 but to the increase in the amount of the ablation gas 31 to be generated. As a result, the contribution of the mechanical compressive effect decreases in achieving the same level of the blasting pressure, and driving energy can be further reduced.

On the bonded surface between the inside-nozzle insulating member 32*a* and the fixed arcing contact 7*a*, there is the triple overlapping point section 33 where the following three media are in contact with each other: the inside-nozzle insulating member 32*a* which is an insulating body, the fixed arcing contact 7*a* which is made of metal, and the arc-extinguishing gas 2. If voltage is applied to the triple overlapping point section 33, the triple overlapping point section 33 becomes a weak point in terms of electric insulation because of the extreme increase of the electric field.

According to the first embodiment, the triple overlapping point section 33 is positioned deeper than the front end section 7*c* of the fixed arcing contact 7*a*. Thanks to the electrostatic shield effect of the front end section 7*c* of the fixed arcing contact 7*a*, the increase of the electric field can be avoided, thereby ensuring an excellent level of safety.

As described above, according to the first embodiment, the low-cost inside-nozzle insulating member 32*a* is provided in the insulating nozzle 6. Therefore, it is possible to achieve an excellent level of cooling performance and to extend product life by limiting the reduction in diameter of the arcing contacts 7*a* and 7*b*.

(2) Second Embodiment

Configuration

A second embodiment of the present invention will be described in detail with reference to FIG. 3. FIG. 3 illustrates a situation near an arc during the opening operation of a gas-insulated circuit breaker. Since the components of the gas-insulated circuit breaker are symmetrical about a symmetry axis, FIG. 3 illustrates only the upper half of the gas-insulated circuit breaker above the central axis.

The configuration of the second embodiment is basically the same as that of the first embodiment except for the following feature. That is, as shown in FIG. 3, an electric field weakening shield 36 is provided at the center of the front end section of the fixed arcing contact 7*a*. The electric field weakening shield 36 is embedded in an inside-nozzle insulating member 32*b*. Incidentally, the reference numeral 35 denotes a rod support attached to the hollow rod 11.

According to the second embodiment, the inside-nozzle insulating member 32*b* has a hollow structure in which a hole 37 is formed. A guide rod 34 that is fixed on the movable contact section 22 is provided along the hole 37 so that the guide rod 34 can slide. The guide rod 34, the hole 37 of the inside-nozzle insulating member 32*b*, the peripheral surface of the inside-nozzle insulating member 32*b*, and the throat section 6*b* of the insulating nozzle 6 are all disposed coaxially.

As in the conventional case, the base materials of the inside-nozzle insulating member 32*b* are insulating materials such as polytetrafluoroethylene. BN (Boron Nitride) powder or the like is added to the inside-nozzle insulating member 32*b*. The powder has high reflex action for ultraviolet rays emitted from the arc. Moreover, pigment additives, such as the powder of $Ti_2$—CoO—NiO—ZnO or CoO—$Al_2O_3$—$Cr_2O_3$, are added to the inside-nozzle insulating member 32*b*. The pigment additives are excellent in absorption of the visible light range. The additives are the special feature of the inside-nozzle insulating member 32*b*.

Furthermore, the arc-extinguishing gas 2 used here is lower in Global Warming Potential (which is a measure of how much a gas contributes to global warming relative to $CO_2$ gas whose GWP is 1) than the typical SF6 gas. There are considered to be many candidates that have less impact on the environment and can substitute for SF6. Here, the inexpensive, uninflammable $N_2$ gas is used as one example. $N_2$ gas have little impact on the environment and no toxicity.

Operation and Advantages

According to the second embodiment, since the inside-nozzle insulating member 32*b* is provided, the cooling performance of the arc 8 is improved structurally. Therefore, it is possible to secure the same excellent level of opening performance as SF6 gas, even as the lower-cooling-performance substitute gas like N2 or CO2 gas is used as the arc-extinguishing gas 2. That is, the gas that has less impact on the environment can be used as the arc-extinguishing gas 2. Therefore, while the opening performance is maintained at a satisfactory level, the amount of SF6 gas used can be reduced to strengthen harmony with the environment.

Moreover, according to the second embodiment, the following preferable advantages are also obtained. That is, thanks to the electrostatic shield effect of the electric field weakening shield 36 provided at the center of the front end section of the fixed arcing contact 7*a*, the electric field of the front end section 7*c* of the fixed arcing contact 7*a* and the electric field of the triple overlapping point section 33 are further reduced. Therefore, the necessary separation distance of the arcing contacts 7*a* and 7*b*, i.e. the moving distance of the movable contact section 22, and the separating speed of the arcing contacts 7*a* and 7*b* can be further reduced. Thus, the reduction effect of the driving energy further improves.

Moreover, each of the components vibrates significantly at the time of interrupting the arc 8 due to the driving of the movable contact section 22 and the high-pressure gas flow 10*c*. However, according to the second embodiment, the guide rod 34 slides along the hole 37 in the inside-nozzle insulating member 32*b*, ensuring that the inside-nozzle insulating member 32*b* is supported at the time of opening operation. Therefore, the co-axial relation between the inside-nozzle insulating member 32*b* and the throat section 6*b* of the insulating nozzle 6 is steadily maintained.

Accordingly, even if each of the components vibrates at the time of interrupting the arc 8, the arc 8 does not bias to one side, and the stable opening performance can be obtained. Moreover, at the time of the turn-on operation, the fixed arcing contact 7*a* does not move because the fixed arcing contact 7*a* is supported by the guide rod 34. Therefore, the throat section 6*b* of the insulating nozzle 6 does not rub and damage the front end section 7*c*, thereby achieving an excellent level of safety.

Moreover, as described above, after being exposed to the high-temperature arc 8 that reaches several tens of thousands K around an over-current peak, the inside-nozzle insulating member 32*b* melts and is gasified in the process of interrupting the arc 8, producing the ablation gas 31. At this time, there is a possibility that carbon included in the insulating nozzle 6 is released and separated out by the strong action of ultraviolet rays from the arc 8. If the free carbon is separated out to the inside-nozzle insulating member 32*b*, the conductivity of the free carbon threatens the electric insulation between the arcing contacts 7*a* and 7*b*.

Therefore, according to the second embodiment, BN (Boron Nitride) powder or the like is added to the inside-nozzle insulating member 32*b*. The powder has high reflex action for ultraviolet rays. Thus, it is possible to prevent ultraviolet rays from entering the inside-nozzle insulating member 32*b* from the arc 8. Therefore, it is possible to suppress the generation of the free carbon, improving electric insulation between the arcing contacts 7*a* and 7*b*.

Moreover, according to the second embodiment, pigment additives such as Ti2-CoO—NiO—ZnO, CoO—Al2O3-Cr2O3 are added to the inside-nozzle insulating member 32*b*, wherein the pigment additives are excellent in absorption of the visible light range. Thus, the inside-nozzle insulating member 32*b* can efficiently absorb the arc energy of the visible light range.

Therefore, a larger amount of the ablation gas 31 is generated, contributing to the increase in the pressure of the puffer chamber 5. Accordingly, the contribution ratio of mechanical compression further declines in obtaining the same level of blasting pressure, and driving energy is further reduced.

According to the second embodiment, N2 gas is used as the arc-extinguishing gas. In this case, the cooling performance of the arc 8 may decline compared with SF6 gas because N2 gas and SF6 gas are different in physicochemical properties. However, according to the second embodiment, as described in the first embodiment, the area where the high-temperature part of the arc 8 and the low-temperature gas around the arc 8 are in contact with each other increases significantly in size compared with the conventional structure, leading to a dramatic improvement in the cooling performance of the arc 8. Even if N2 gas is used, deterioration in opening performance is avoided.

According to the above-described second embodiment, in addition to the effects of the first embodiment, the following effects are obtained: the effect of reducing impact on the environment thanks to the use of N2 gas or the like as the arc-extinguishing gas 2, the electrostatic shield effect of the electric field weakening shield 36, and the operation stability effect arising from the guide rod 34. Therefore, harmony with the environment improves, driving energy is reduced, and safety improves.

Furthermore, since the powder that has high reflex action for ultraviolet rays is added to the inside-nozzle insulating member 32*b*, it is possible to suppress the generation of the free carbon, obtaining the high level of reliability in insulation. Moreover, since the pigment additives are added to the inside-nozzle insulating member 32*b*, the arc energy of the visible light range is efficiently absorbed, and the amount of the ablation gas 31 to be generated increases. Therefore, the pressure of the puffer chamber 5 increases, leading to an improvement in opening performance.

(3) Third Embodiment

Configuration

A third embodiment of the present invention will be described with reference to FIG. 4. FIG. 4 illustrates a situation near an arc during the opening operation of a gas-insulated circuit breaker. Since the components of the gas-insulated circuit breaker are symmetrical about a symmetry axis, FIG. 4 illustrates only the upper half of the gas-insulated circuit breaker above the central axis.

As the characteristic configuration of the third embodiment, the gas-insulated circuit breaker is equipped with an inside-nozzle insulating member 32*c* having a taper 38. The taper 38 is thick in diameter around the center of the inside-nozzle insulating member 32*c* and is formed in a curve so as to become thinner toward the end section.

That is, the inside-nozzle insulating member 32*c* on which the taper 38 is formed is not uniform in diameter along the axial direction. Therefore, the gas passage 61*c* of the insulating nozzle 6 of the third embodiment changes in size as the outer diameter of the inside-nozzle insulating member 32*c* changes.

Operation and Advantages

The following are the unique advantages obtained in the above third embodiment. As described above, the inside-nozzle insulating member 32*a* of the first embodiment is in the shape of a cylinder. Therefore, regardless of the degree of separation of the arcing contacts 7*a* and 7*b*, the cylindrical passage cross-section area S2 formed by the outer diameter ϕI of the inside-nozzle insulating member 32*a* and the inner diameter ϕN2 of the throat section 6*b* of the insulating nozzle 6 always remains unchanged in the first embodiment (See FIG. 1).

By contrast, according to the third embodiment, since the taper 38 is formed on the inside-nozzle insulating member 32*c*, the outer diameter of the inside-nozzle insulating member 32*c* and the size of the gas passage 61*c* change depending on the degree of separation of the arcing contacts 7*a* and 7*b*. Therefore, the passage cross-section area S2 can be arbitrarily changed. That is, the passage structure inside the insulating nozzle 6 can be changed every moment in a flexible manner. At any given time, the amount of the gas flow rate flowing through the gas passage 61*c* of the insulating nozzle 6 can be adjusted. Therefore, the opening performance further improves.

For example, when the degree of separation of the arcing contacts 7*a* and 7*b* is small because the arcing contacts 7*a* and 7*b* have just started to separate, the gas passage 6*c* to the fixed arcing contact 7*a* is limited, promoting the intake of the heat of the arc 8 into the puffer chamber 5. Then, when the degree of separation of the arcing contacts 7*a* and 7*b* becomes large at the later stage of the process, the gas passage 61*c* promptly becomes large in size around the fixed arcing contact 7*a* and the movable arcing contact 7*b*, promoting the discharge of heat from the arc 8. In this manner, the cooling performance of the arc 8 further improves, and the opening performance further improves.

Incidentally, the shape of the taper 38 of the inside-nozzle insulating member 32*c* can be changed when necessary. The structure of the gas passage 61*c* is designed appropriately depending on each of the degree of separation of the arcing contacts 7*a* and 7*b*, thereby preventing the heat exhausted from the arc 8 from burning out the components. In addition, a variety of preferable advantages can be obtained.

(4) Fourth Embodiment

Configuration

A fourth embodiment of the present invention will be described in detail with reference to FIG. 5. As shown in FIG. 5, the components of a gas-insulated circuit breaker are symmetrical about a symmetry axis. The upper portion of FIG. 5 above the central axis illustrates a state (closed state) in which the gas-insulated circuit breaker is turned on, and the lower portion of FIG. 5 illustrates a state during the process of opening.

According to the above-described first to third embodiments, the inside-nozzle insulating members 32*a* to 32*c* are so formed as to be connected to the fixed arcing contacts 7*a*. However, the same function can be obtained even if the inside-nozzle insulating members 32*a* to 32*c* are connected to the movable contact section 22. Therefore, according to the fourth embodiment, an inside-nozzle insulating member 32*d* is firmly fixed by a support 35 of the movable hollow rod 11 (see FIG. 5). Like those of the above-described first to third embodiments, the inside-nozzle insulating member 32*d* is so formed as to keep a co-axial relation with the throat section 6*b* of the insulating nozzle 6.

Moreover, according to the fourth embodiment, as a member corresponding to the conventional fixed arcing contact, an opposing arcing contact 7*d* is provided. The opposing arcing contact 7*d* is so formed as to be driven in a direction opposite to the movable contact section 22 with the help of the inside-nozzle insulating member 32*d*. Many other versions of such a specific configuration are possible. Here, as shown in FIG. 5, racks 38 are provided on the inside-nozzle insulating member 32*d* and the opposing arcing contact 7*d*. The opposing arcing contact 7*d* moves in a direction opposite to the movable arcing contact 7*b* with the help of pinions 87.

Operation and Advantages

The basic advantages obtained by the fourth embodiment having the above configuration are the same as those of the above-described first to third embodiments. However, the fourth embodiment has the following unique advantages. That is, since the arcing contacts 7*a* and 7*b* move relative to each other, less driving energy is required to obtain the same separating speed of the arcing contacts 7*a* and 7*b*. As shown in FIG. 5, relative moved distance between the fixed contact section 21 and the movable contact section 22 is the sum of the moved distance L1 of the fixed contact section 21 and the moved distance L2 of the movable contact section 22. For example, when the separating speed "100" per second is necessary, the movable arcing contact 7*b* and the opposing arcing contact 7*d* each separate at the speed of "50," contributing to the reduction in required driving energy.

Moreover, in order to realize the above configuration, a mechanical structure for opposite driving is necessary. Therefore, it is necessary to provide the driving mechanism on both sides or a complex link mechanism. However, according to the present embodiment, a mechanical structure is provided with the use of the inside-nozzle insulating member 32*d* positioned at the center of the gas-insulated circuit breaker. Therefore, the mechanical structure for opposite driving can be extremely simplified, and the advantage is that the configuration can be simplified.

(5) Other Embodiments

The present invention is not limited to the above-described embodiments. The configuration of each of the components, the number of components to be disposed, and the like can be selected when necessary. For example, as for a gas that fills up the sealed container, a single or mixed gas, which has the lower Global Warming Potential than SF6 gas and which is in a gas phase at, at least, 1 atmosphere or more and at 20 degrees Celsius or less, is desirable given the impact on the environment. Moreover, as a material that is added to the inside-nozzle insulating member, has high reflex action for ultraviolet rays, and is excellent in absorption of the visible light range to the ultraviolet range, a heat resistance resin mixed with additives that are better than polytetrafluoroethylene is desirable.

Furthermore, the features of the above-described embodiments can be combined.

What is claimed is:

1. A gas-insulated circuit breaker comprising:

a sealed container filled with a gas;

a pair of contacts so constructed as to be connected and separated each other as desired in the sealed container;

gas flow generation means for blasting the gas on an arc generated when the contacts are separated, the gas flow generation means including: at least one pressure accumulation space, at least one pressure increasing means for increasing the pressure of the pressure accumulation space, at least one gas passage that connects the pressure accumulation space to the arc, and an insulating nozzle that controls the flow of the gas from the pressure accumulation space to lead the gas to the arc;

an inside-nozzle insulating member disposed co-axially with respect to the insulating nozzle inside the insulating nozzle, wherein the arc is generated in a space between an inner wall section of the insulating nozzle and an outer wall section of the inside-nozzle insulating member, and the gas flows in the space.

2. The gas-insulated circuit breaker according to claim 1, wherein:

the pair of the contacts, the gas passage inside the insulating nozzle, and the inside-nozzle insulating member are substantially symmetrical about a symmetry axis; and when outer diameter of one of the contacts, inner diameter of another one of the contacts, diameter of the gas passage inside the insulating nozzle, and outer diameter of the inside-nozzle insulating member are assumed to be $\phi F$, $\phi M$, $\phi N$, and $\phi I$ respectively, there is a relation $\phi N > \phi F > \phi M > \phi I$.

3. The gas-insulated circuit breaker according to claim 1, wherein at least one of the pressure increasing means is realized by the heat energy generated from the arc.

4. The gas-insulated circuit breaker according to claim 1, wherein:

the inside-nozzle insulating member is connected to and held by one of the contacts at a connection section; and a triple overlapping point where three media which are metal of the connection section, the insulating body, and the gas are in contact with each other is positioned deeper than a peripheral section of the contact.

5. The gas-insulated circuit breaker according to claim 1, wherein:

the inside-nozzle insulating member is inserted into one of the contacts to be connected to and held by the contact;

an electric field weakening shield is disposed on a central axis of the contact as to project into the inside-nozzle insulating member; and electric potential of the electric field weakening shield is same as electric potential of the contact into which the inside-nozzle insulating member is inserted.

6. The gas-insulated circuit breaker according to claim 1, wherein:

a hole is formed in the inside-nozzle insulating member in axial direction; and a guide rod that does not move in any direction other than the axial direction is so provided as to slide along the hole of the inside-nozzle insulating member.

7. The gas-insulated circuit breaker according to claim 1, wherein the inside-nozzle insulating member is made of a heat resistance resin mixed with additives that are better than polytetrafluoroethylene in terms of reflex action for ultraviolet rays.

8. The gas-insulated circuit breaker according to claim 1, wherein the inside-nozzle insulating member is made of a heat resistance resin mixed with additives that are better than polytetrafluoroethylene in terms of absorption of visible light range to ultraviolet range.

9. The gas-insulated circuit breaker according to claim 1, wherein the inside-nozzle insulating member is symmetrical about a symmetry axis, and a taper section is so formed on the inside-nozzle insulating member as not to be uniform in diameter along axial direction.

10. The gas-insulated circuit breaker according to claim 1, wherein the inside-nozzle insulating member is so connected and held as to move in same way as one of the contacts, and is also mechanically connected to another one of the contacts such that the contacts move in opposite directions.

11. The gas-insulated circuit breaker according to claim 1, wherein the gas is a single or mixed gas that is lower in Global Warming Potential than sulfur hexafluoride gas and is in a gas phase at 1 atmosphere or more and at 20 degrees Celsius or less.

* * * * *